US006674429B1

(12) United States Patent
Correa et al.

(10) Patent No.: US 6,674,429 B1
(45) Date of Patent: Jan. 6, 2004

(54) METHOD FOR POWER LEVEL CONTROL OF A DISPLAY AND APPARATUS FOR CARRYING OUT THE METHOD

(75) Inventors: Carlos Correa, Villingen-Schwenningen (DE); Sebastien Weitbruch, Mönchweiler (DE); Rainer Zwing, Villingen-Schwenningen (DE)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 09/890,561

(22) PCT Filed: Jan. 20, 2000

(86) PCT No.: PCT/EP00/00408

§ 371 (c)(1),
(2), (4) Date: Aug. 1, 2001

(87) PCT Pub. No.: WO00/46782

PCT Pub. Date: Aug. 10, 2000

(30) Foreign Application Priority Data

Feb. 1, 1999 (EP) ..... 99101977

(51) Int. Cl.[7] ..... G09G 3/28; G09G 3/30; G09G 3/36; G09G 5/00; G09G 5/10

(52) U.S. Cl. ..... 345/211; 345/63; 345/77; 345/89; 345/690

(58) Field of Search ..... 345/60, 63, 77, 345/20, 89, 690, 692, 211–214

(56) References Cited

U.S. PATENT DOCUMENTS 5,757,343 A 5/1998 Nagakubo ..... 345/63
6,369,782 B2 * 4/2002 Shigeta ..... 345/63
6,459,212 B2 * 10/2002 Tokunaga et al. ..... 315/169.4
6,462,721 B2 * 10/2002 Kasahara et al. ..... 345/63
6,476,824 B1 * 11/2002 Suzuki et al. ..... 345/690
6,535,224 B2 * 3/2003 Kuriyama et al. ..... 345/690

FOREIGN PATENT DOCUMENTS

EP 774 745 A2 5/1997 ..... G09G/3/28
EP 841 652 A1 5/1998 ..... G09G/3/28
EP 874 349 A1 10/1998 ..... G09G/3/28
JP 06 259034 A 9/1994 ..... G09G/3/20

* cited by examiner

*Primary Examiner*—Richard Hjerpe
*Assistant Examiner*—Duc Q Dinh
(74) *Attorney, Agent, or Firm*—Joseph S. Tripoli; Harvey D. Fried; Sammy S. Henig

(57) ABSTRACT

A method for power level control in a Plasma Display Panel with which the Peak White Enhancement Factor can be increased. The method includes the provision of a set of power level modes for the sub-field coding. To each power level mode a characteristic sub-field organization belongs. The sub-field organization is variable in respect to one or more of the following characteristics:

the number of sub-fields
the sub-field type
the sub-field positioning
the sub-field weight
the sub-field pre-scaling
a factor for the sub-field weights which is used to vary the amount of small pulses generated during each sub-field.

The method includes the steps of determining a value which is characteristic for the power level of a video picture and selecting a corresponding power level mode for sub-field coding.

6 Claims, 2 Drawing Sheets

METHOD FOR POWER LEVEL CONTROL OF A DISPLAY AND APPARATUS FOR CARRYING OUT THE METHOD

This application claims the benefit under 35 U.S.C. § 365 of International Application PCT/EP00/00408, filed Jan. 20, 2000, which was published in accordance with PCT Article 21(2) on Aug. 10, 2000 in English, and which claims the benefit of EP Application No. 99101977.9, filed Feb. 01, 1999.

BACKGROUND OF THE INVENTION

1. Field of the Invention

The invention relates to a method for power level control of a display device and an apparatus for carrying out the method.

More specifically the invention is closely related to a kind of video processing for improving the picture quality of pictures which are displayed on displays like plasma display panels (PDP), and all kind of displays based on the principle of duty cycle modulation (pulse width modulation) of light emission.

2. Description of Prior Art

Although plasma display panels are known for many years, plasma displays are encountering a growing interest from TV manufacturers. Indeed, this technology now makes it possible to achieve flat colour panels of large size and with limited depths without any viewing angle constraints. The size of the displays may be much larger than the classical CRT picture tubes would have ever been allowed.

Referring to the latest generation of European TV sets, a lot of work has been made to improve its picture quality. Consequently, there is a strong demand, that a TV set built in a new technology like the plasma display technology has to provide a picture so good or better than the old standard TV technology.

One important quality criterion for a video picture is the Peak White Enhancement Factor (PWEF). The Peak White Enhancement Factor can be defined as the ratio between the peak white luminance level, to the luminance of a homogeneous white field/frame. CRT based displays have PWEF values of up to 5, but present Plasma Display Panels, (PDP), have PWEF values of about 2 only. Therefore, under this aspect the picture quality of PDPs is not the best and efforts must be taken to improve this situation.

A Plasma Display Panel (PDP) utilises a matrix array of discharge cells which could only be "ON" or "OFF". Also unlike a CRT or LCD in which grey levels are expressed by analogue control of the light emission, a PDP controls the grey level by modulating the number of light pulses per frame (sustain pulses). This time-modulation will be integrated by the eye over a period corresponding to the eye time response.

SUMMARY OF THE INVENTION

It is an object of the present invention to disclose a method and an apparatus for power level control which results in an increase of the Peak White Enhancement Factor.

The present invention, reports a technique that increases the PWEF of a PDP by increasing the number of available power level modes, in number and in range.

The invention starts from the reflection that for larger peak white luminance values in plasma displays more sustain pulses are necessarily required. On the other hand, more sustain pulses correspond also to a higher power consumption of the PDP. The solution is a control method which generates more or less sustain pulses as a function of average picture power, i.e., it switches between different modes with different power levels. For clarity the power level of a given mode, is defined here as the number of sustain discharges activated for a video level of 100 IRE (Institute of Radio Engineers) Therein, the relative unit 100 IRE denotes the video signal level for the full white colour. The available range of power level modes, is approximately equal to the PWEF. For pictures having relatively low picture power, i.e. a lot of pixels with relatively low luminance value, a mode will be selected which has a subsequently high power level to create the different video levels because the overall power consumption will be limited due to a great amount of pixels with low luminance value. For pictures having relatively high picture power, i.e. a lot of pixels with relatively high luminance value, a mode will be selected which has a subsequently low power level to create the different video levels because the overall power consumption will be high due to a great amount of pixels with high luminance value.

In principle the invention consists of a method for power level control in a display device having a plurality of luminous elements corresponding to the pixels of a picture, wherein the time duration of a video frame or video field is divided into a plurality of sub-fields (SF) during which the luminous elements may be activated for light emission in small pulses corresponding to a sub-field code word which is used for brightness control, characterised in that a set of power level modes is provided for sub-field coding, wherein to each power level mode a characteristic sub-field organisation belongs, the sub-field organisations being variable in respect to one or more of the following characteristics:

the number of sub-fields the sub-field type the sub-field positioning the sub-field weight the sub-field pre-scaling a factor for the sub-field weights which is used to vary the amount of small pulses generated during each sub-field;

wherein the method comprises the steps of determining a value (AP) which is characteristic for the power level of a video picture and selecting a corresponding power level mode for the sub-field coding.

Advantageously, additional embodiments of the inventive method are disclosed in the respective dependent claims.

Contrary to CRTs, where the switching is analogue, between a continuous and in principle infinite number of modes, in PDPs the switching is discrete. By introducing an hysteresis like switching behaviour of the power level modes an oscillation between two power level modes, with perceptible differences in luminance, caused by picture noise is avoided (see claim 4 and 5).

The invention consists further in an apparatus for carrying out the inventive method. Here, the invention consists of an apparatus for carrying out the inventive method which comprises an average picture power measuring circuit, a pre-scaling unit, a sub-field coding unit and a power level control unit in which a table of power level modes and a hysteresis curve for power level mode switching control is stored.

BRIEF DESCRIPTION OF THE DRAWINGS

Exemplary embodiments of the invention are illustrated in the drawings and are explained in more detail in the following description.

In the figures.

DETAILED DESCRIPTION

In the field of video processing is an 8-bit representation of a luminance level very common. In this case each video level will be represented by a combination of the following 8 bits:

$2^0=1$, $2^1=2$, $2^2=4$, $2^3=8$, $2^4=16$, $2^5=32$, $2^6=64$, $2^7=128$

Figure 1:
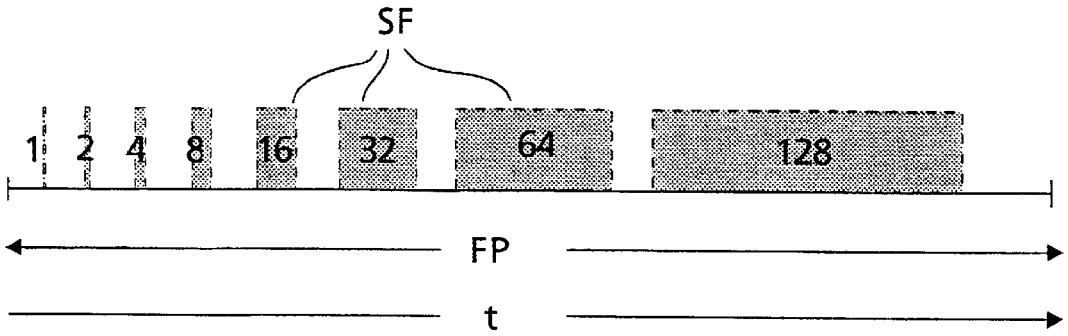
FIG. 1 shows an illustration for explaining the sub-field concept of a PDP.

To realise such a coding scheme with the PDP technology, the frame period will be divided in 8 sub-periods which are also very often referred to sub-fields, each one corresponding to one of the 8 bits. The duration of the light emission for the bit $2^1=2$ is the double of that for the bit $2^0=1$ etc. With a combination of these 8 sub-periods, we are able to build 256 different grey levels. E.g. the grey level 92 will thus have the corresponding digital code word %1011100. It should be appreciated, that in PDP technology the sub-fields consist each of a corresponding number of small pulses with equal amplitude and equal duration. Without motion, the eye of the observer will integrate over about a frame period all the sub-periods and will have the impression of the right grey level. The above-mentioned sub-field organisation is shown in FIG. 1. Note that FIG. 1 is simplified in that respect that the time periods for addressing the plasma cells and for erasing the plasma cells after addressing (scanning) and sustaining are not explicitly shown. However, they are present for each sub-field in plasma display technology which is well known to the skilled man in this field. These time periods are mandatory and constant for each sub-field.

When all sub-fields are activated, the lighting phase has a relative duration of 255 relative time units. The value of 255 has been selected in order to be able to continue using the above mentioned 8 bit representation of the luminance level or RGB data which is being used for PDPs. The second sub-field in FIG. 1 has e.g. a duration of 2 relative time units. In the field of PDP technology, the relative duration of a sub-field is often referred to the 'weight' of a sub-fields, the expression will also be used hereinafter.

An efficient peak white enhancement control circuit requires a high number of discrete power level modes for mapping the 8 bit words of video signal level (RGB-, YUV-signals) to respective sub-field code words. Switching is done between the different power level modes. In this invention the number of discrete power levels is increased by adding more degrees of freedom, i.e. by using a more dynamic control of sub-fields.

The invention proposes to use of one or more of the following processes to provide dynamic sub-field control:

1. Dynamic number of sub-fields. This means that for the higher power level modes (selected for pictures with lower average power), less sub-fields are used, thus reducing the required time for addressing and erasing, which allows for more time for the generation of sustain pulses.

2. Dynamic sub-field types. This means that for some power level modes, some fields may collapse to a bit-line-repeat sub-field, which require only half of the time for addressing. Again, more time becomes available for the generation of sub-field modes. The concept of bit-line-repeat sub-fields is explained in detail in EP 0 874 349. The idea behind this concept is to reduce for some sub-fields called common sub-fields the number of lines to be addressed by grouping two consecutive lines together. So, some sub-fields are defined to be common sub-fields. An example is given below for a sub-fields organisation with 12 sub-fields. The underlined values are the common sub-fields.

$\underline{1}$-$\underline{2}$-$\underline{4}$-5-$\underline{8}$-10-$\underline{15}$-20-$\underline{30}$-40-50-70

In that case, the sub-field code words of two pixel values of two pixels in two consecutive lines at the same position will be identical for the common sub-fields but may differ for the remaining specific sub-fields. An example is given below for the pixel values 36 and 51 located at the same position on two consecutive lines.

There are different possibilities to encode these values as shown below. Note that in brackets the corresponding codes for the 6 common sub-fields are indicated.

| | | | | | |
|---|---|---|---|---|---|
| 36 | = | $\underline{30}$+ $\underline{4}$+ 2 (100110) | 51 | = | 50 + 1(000001) |
| | = | $\underline{30}$+ 5 + 1(100001) | | = | 40 + 10 + 1(000001) |
| | = | 20 + 15+ 1(010001) | | = | 40 + 8+ 2 + 1(001011) |
| | = | 20 + 10 + 5 + 1(000001) | | = | 40 + 5 + $\underline{4}$+ 2 (000110) |
| | = | 20 + 10 + $\underline{4}$+ 2 (000110) | | = | $\underline{30}$+ 20 + 1 (100001) |
| | = | 20 + 8+ 5 + $\underline{2}$+ 1(001011) | | = | $\underline{30}$+ 10 + 8+ $\underline{2}$+ 1(101011) |
| | = | 15 + 10 + 8+ $\underline{2}$+ 1(011011) | | = | $\underline{30}$+ 10 + 5 + $\underline{4}$+ 2 (100110) |
| | = | 15 + 10 + 5 + $\underline{4}$+ 2 (010110) | | = | 20 + 15+ 10 + 5 + 1(010001) |
| | | | | = | 20 + 15+ 10 + $\underline{4}$+ 2 (010110) |
| | | | | = | 20 + 15+ 8+ 5 + $\underline{2}$+ 1(011011) |

From this listing it is apparent which code words can be taken to have the identical code words in respect to the common sub-fields. These corresponding pairs of code words are listed below:

| | | |
|---|---|---|
| 36 = $\underline{30}$+ $\underline{4}$+ 2 | and | 51 = $\underline{30}$+ 10 + 5 + $\underline{4}$ + 2 |
| 36 = $\underline{30}$+ 5 + $\underline{1}$ | and | 51 = $\underline{30}$+ 20 + $\underline{1}$ |
| 36 = 20 + $\underline{15}$ + $\underline{1}$ | and | 51 = 20 + $\underline{15}$ + 10 + 5 + $\underline{1}$ |
| 36 = 20 + 10 + 5 + $\underline{1}$ | and | 51 = 50 + $\underline{1}$ |
| 36 = 20 + 10 + 5 + $\underline{1}$ | and | 51 = 40 + 10 + $\underline{1}$ |
| 36 = 20 + 10 + $\underline{4}$ + 2 | and | 51 = 40 + 5 + $\underline{4}$+ 2 |
| 36 = 20 + $\underline{8}$ + 5 + $\underline{2}$ + $\underline{1}$ | and | 51 = 40 + $\underline{8}$ + $\underline{2}$+ $\underline{1}$ |
| 36 = $\underline{15}$ + 10 + $\underline{8}$ + $\underline{2}$ + $\underline{1}$ | and | 51 = 20 + $\underline{15}$ + $\underline{8}$ + 5 + $\underline{2}$ + $\underline{1}$ |
| 36 = $\underline{15}$ + 10 + 5 + $\underline{4}$ + 2 | and | 51 = 20 + $\underline{15}$ + 10 + $\underline{4}$ + 2 |

3. Dynamic sub-field positioning. This means that the position of sub-fields within a video frame is also variable. This allows for more freedom for building a frame from the discrete sub-fields.

4. Dynamic sub-field pre-scaling. This means that the highest video level of 100 IRE is not coded always with the same digital value, e.g., 255. If, for instance, 100 IRE is pre-scaled to a different smaller value, say 240, picture power is reduced by the same factor, i.e. 240/255.

5. Dynamic sub-field weights. This means that the weight associated with a given sub-field may change. This is the normal case when a different number of sub-fields is used, but it is also possible to have two different power level modes, with the same number of sub-fields, probably with different sub-field pre-scaling, but with a different coding and thus with a different sub-field weighting. An example for this is given below:

mode 10.1: 1-2-4-8-16-32-48-48-48-48 mode 10.2: 1-2-4-8-16-32-32-32-32-32

In this example the weights of the sevenths to tenth sub-fields are different for the two modes.

6. Dynamic sub-field weight factor. The sub-field weight factor determines how much sustain pulses are produced for the sub-fields. E.g. if this factor is *2, that means that the sub-field weight number is to be multiplied by two to achieve the number of sustain pulses which are generated during an active sub-field period.

Figure 2:
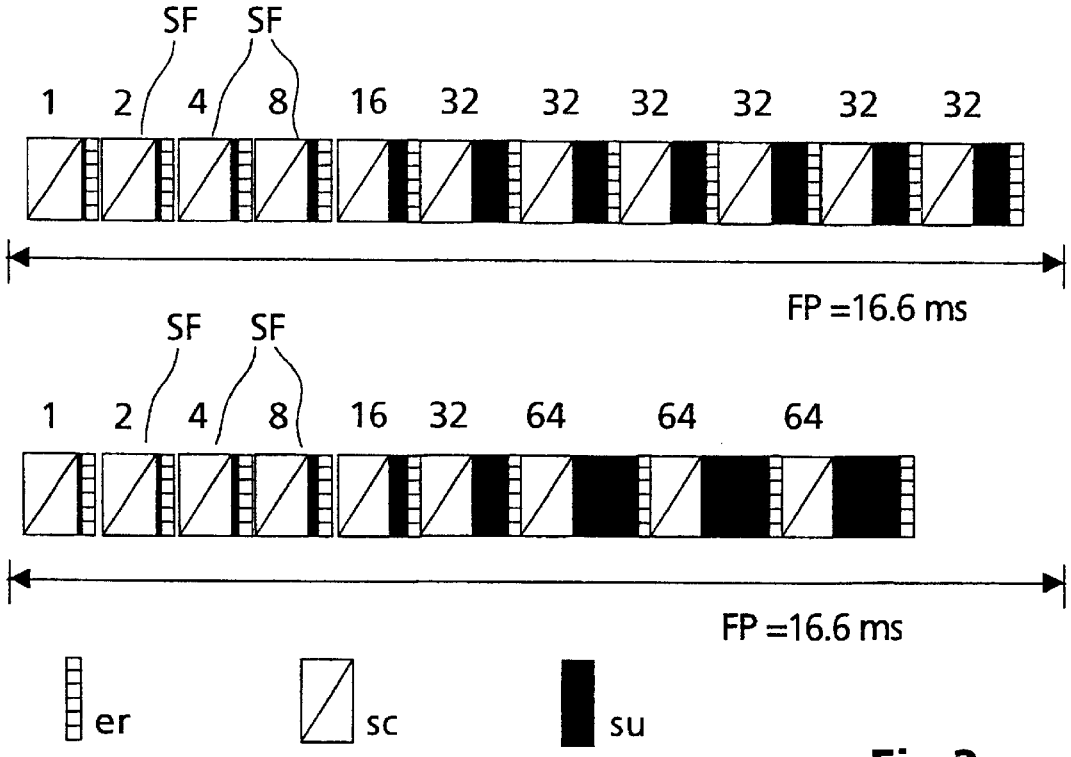
FIG. 2 shows two different sub-field organisations to illustrate the concept of switching between different power level modes for peak white enhancement.

In FIG. 2 it is briefly shown how the principle of dynamic sub-field organisation works. Two modes with different power levels are shown.

The first mode is composed of 11 sub-fields SF and the second mode is composed of 9 sub-fields. Each sub-field SF consists of an addressing period sc (scan period) where each plasma cell is charged or not charged determined by the code word for each pixel, a sustain period su where the pre-charged plasma cells are activated for light emission and an erase period er, where the plasma cells are discharged. In the 9 sub-field case, less time is required for addressing (scan), and therefore more time is available for sustain pulses (the area in black is larger). The erase and scan time of a sub-field is independent of the corresponding sub-field weight. It can be seen from the figure, that the sub-field position and the sub-field weight is different for the two shown cases. For instance in the first shown case, the weight of the seventh sub-field is 32, but for the second case, the weight of the seventh sub-field is 64. The depicted relative time duration for addressing, erasing and sustain times are, only exemplary and may be different in certain implementations. Also its not mandatory, that the sub-fields with low weights are positioned at the beginning and the sub-fields with higher weights are positioned at the end of the field/frame period.

The concept of dynamic sub-field control can best be explained by means of an example. It is strongly noted that values used here are only exemplary and in another implementations different values can be used, in particular the number and weight of the used sub-fields and the number of actual sustain pulses.

With the example presented here, a PWEF of 5 can be realised. The video signals (e.g. RGB signals) will be represented by 8 bit data words covering the range from 0 to 255. In this example the plasma display panel control generates a maximum of 5*255 pulses in one frame period (highest power level-mode) and a minimum of 1*255 pulses (for 100 IRE) in the mode with lowest power level.

A solution can be implemented with 4 different main power level modes:

Mode 1: 12 sub-fields (2*255 sustain pulses):

1-2-4-8-16-32-32-32-32-32-32-32

Mode 2: 11 sub-fields (3*255 sustain pulses)

1-2-4-8-16-32-32-40-40-40-40

Mode 3: 10 sub-fields (4*255 sustain pulses):

1-2-4-8-16-32-48-48-48-48

Mode 4: 9 sub-fields (5*255 sustain pulses):

1-2-4-8-16-32-64-64-64

The explanation given in brackets is to be interpreted in the following sense: The numbers printed in bold give the sub-field weights in relative time units. For the video level 255 all sub-fields are activated which corresponds to 255 relative time units. The figures for the sub-fields do not directly give the number of sustain pulses in an activated sub-field. These numbers are achieved by multiplying the sub-field weight number with the factors *2, *3, *4, *5 for modes 1, 2, 3, 4.

Every of this main modes is subdivided in about 16 submodes, which use the same number of sub-fields, but which encode the full video level 100 IRE to a different value (dynamic pre-scaling). The following list presents all the submodes, where "pl" denotes the power level (achieved by multiplying the code for 100 IRE with the corresponding factor of the main mode), and "100 IRE" denotes the digital level to which 100 IRE video level is coded:

Mode 1.01: pl=254, 100 ire=127

Mode 1.02: pl=270, 100 ire=135

Mode 1.03: pl=286, 100 ire=143

Mode 1.04: pl=302, 100 ire=151

Mode 1.05: pl=318, 100 ire=159

Mode 1.06: pl=334, 100 ire=167

Mode 1.07: pl=350, 100 ire=175

Mode 1.08: pl=366, 100 ire=183

Mode 1.09: pl=382, 100 ire=191

Mode 1.10: pl=398, 100 ire=199

Mode 1.11: pl=414, 100 ire=207

Mode 1.12: pl=430, 100 ire=215

Mode 1.13: pl=446, 100 ire=223

Mode 1.14: pl=462, 100 ire=231

Mode 1.15: pl=478, 100 ire=239

Mode 1.16: pl=494, 100 ire=247

Mode 1.17: pl=510, 100 ire=255

Mode 2.01: pl=525, 100 ire=175

Mode 2.02: pl=540, 100 ire=180

Mode 2.03: pl=555, 100 ire=185

Mode 2.04: pl=570, 100 ire=190

Mode 2.05: pl=585, 100 ire=195

Mode 2.06: pl=600, 100 ire=200

Mode 2.07: pl=615, 100 ire=205

Mode 2.08: pl=630, 100 ire=210

Mode 2.09: pl=645, 100 ire=215

Mode 2.10: pl=660, 100 ire=220

Mode 2.11: pl=675, 100 ire=225

Mode 2.12: pl=690, 100 ire=230

Mode 2.13: pl=705, 100 ire=235

Mode 2.14: pl=720, 100 ire=240

Mode 2.15: pl=735, 100 ire=245

Mode 2.16: pl=675, 100 ire=250

Mode 2.17: pl=765, 100 ire=255

Mode 3.01: pl=780, 100 ire=195

Mode 3.02: pl=796, 100 ire=199

Mode 3.03: pl=812, 100 ire=203

Mode 3.04: pl=828, 100 ire=207

Mode 3.05: pl=844, 100 ire=211

Mode 3.06: pl=860, 100 ire=215
Mode 3.07: pl=876, 100 ire=219
Mode 3.08: pl=892, 100 ire=223
Mode 3.09: pl=908, 100 ire=227
Mode 3.10: pl=924, 100 ire=231
Mode 3.11: pl=940, 100 ire=235
Mode 3.12: pl=956, 100 ire=239
Mode 3.13: pl=972, 100 ire=243
Mode 3.14: pl=988, 100 ire=247
Mode 3.15: pl=1004, 100 ire=251
Mode 3.16: pl=1020, 100 ire=255
Mode 4.01: pl=1035, 100 ire=207
Mode 4.02: pl=1050, 100 ire=210
Mode 4.03: pl=1065, 100 ire=213
Mode 4.04: pl=1080, 100 ire=216
Mode 4.05: pl=1095, 100 ire=219
Mode 4.06: pl=1110, 100 ire=222
Mode 4.07: pl=1125, 100 ire=225
Mode 4.08: pl=1140, 100 ire=228
Mode 4.09: pl=1155, 100 ire=231
Mode 4.10: pl=1170, 100 ire=234
Mode 4.11: pl=1185, 100 ire=237
Mode 4.12: pl=1200, 100 ire=240
Mode 4.13: pl=1215, 100 ire=243
Mode 4.14: pl=1230, 100 ire=246
Mode 4.15: pl=1245, 100 ire=249
Mode 4.16: pl=1260, 100 ire=252
Mode 4.17: pl=1275, 100 ire=255

As it can be seen from the above table, the power level increases gradually from 254 up to 1275, thereby realising a PWEF of 5. There is a total of about 64 power level modes. With the principle of this invention it is no problem to increase this number if required.

In this example four of the above described dynamic sub-field processes are used: Dynamic number of sub-fields, dynamic sub-field positioning, dynamic sub-field weights, dynamic sub-field encoding (pre-scaling) and dynamic sub-field weight factors. It does not use dynamic sub-field types (no bit-line-repeat sub-fields).

Figure 3:
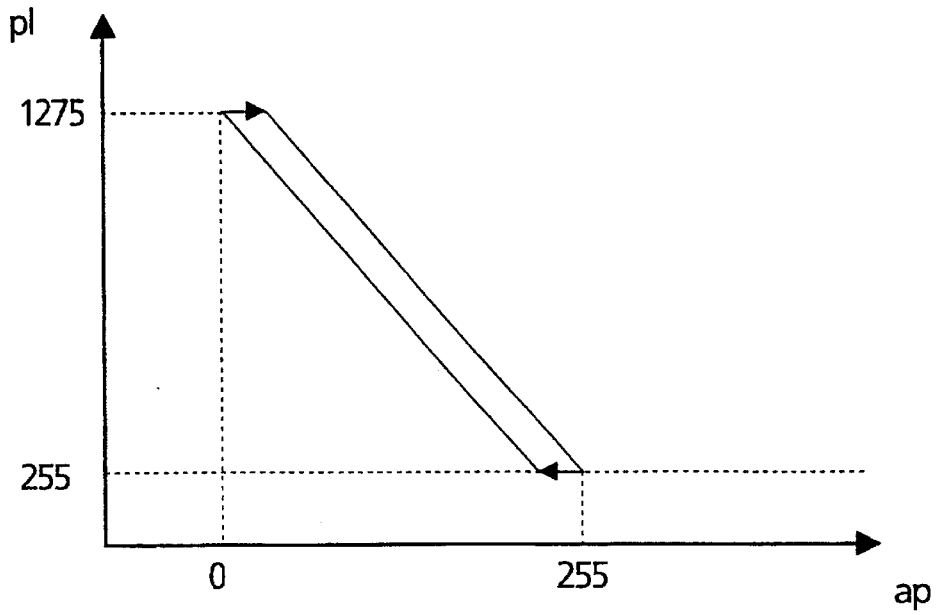
FIG. 3 shows a hystersis curve used for power level switching control.

As already explained above, the power level control method measures the average power of a given picture and switches between corresponding power level modes for sub-field coding. It is possible to make a direct correspondence from the measured average power to a given corresponding power level. However, there is the disadvantage that two adjacent discrete power level modes, have slightly different luminance levels, and thus a direct coupling could cause perceptible luminance oscillations, because even very low levels of picture noise produce some noise on the measured average power value. To avoid these oscillations it is proposed to implement an hysteresis like switching behaviour for the power level mode switching. This behaviour can be implemented according to FIG. 3. FIG. 3 shows a hysteresis curve for the dynamic control of the power level mode selection (pl) as a function of the measured picture average power (ap).

When picture power level increases, modes are selected with decreasing power levels. The following rules are valid for the switching control: 1.) When picture average power is increasing, modes with power levels on the top line are chosen. 2.) When picture average power is decreasing, modes with power levels on the bottom line are chosen. 3.) In case the picture average power growth direction changes, the switching to a new power level mode is suppressed until the picture average power level lies on the respective other bottom or top line. In this way an oscillation between power level modes due to small changes in picture average power is avoided.

Figure 4:
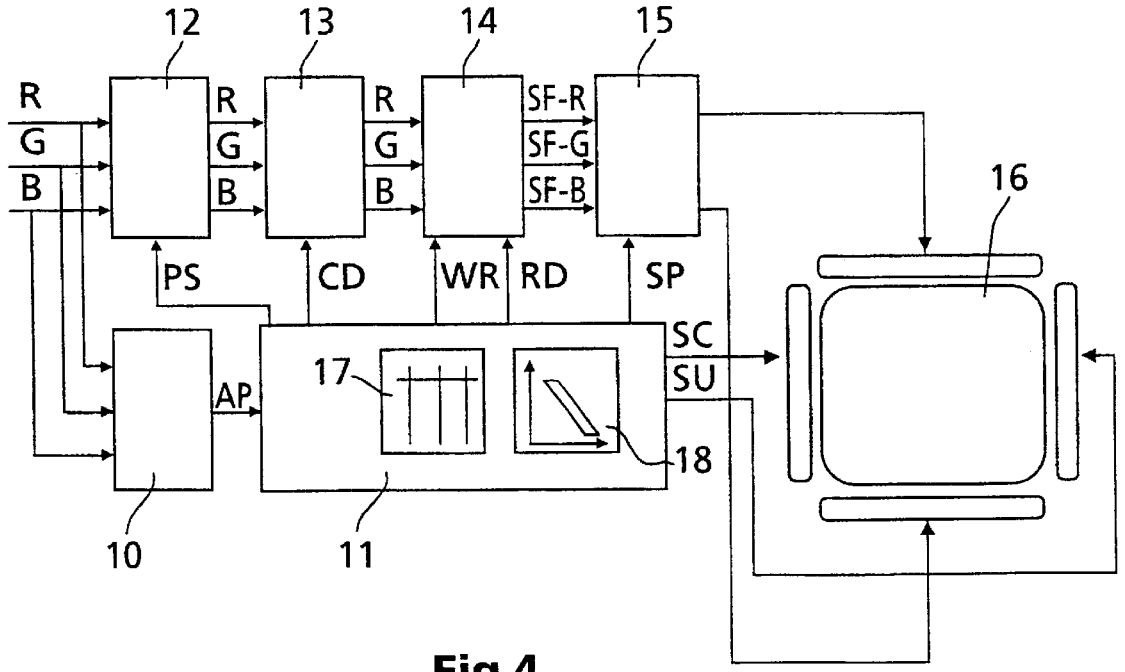
FIG. 4 shows a block diagram of the apparatus according to the invention.

In FIG. 4 a block diagram of a circuit implementation for the above explained method is shown. RGB data is analysed in the average power measure block 10 which gives the computed average power value AP to the PWEF control block 11. The average power value of a picture can be calculated by simply summing up the pixel values for all RGB data streams and dividing the result through the number of pixel values multiplied by three. The control block, consults its internal power level mode table, taking in consideration the previous measured average power value and the stored hysteresis curve. It directly generates the selected mode control signals for the other processing blocks. These are the selection of the pre-scaling factor PS and the sub-field coding parameters CD. These parameters define the number of sub-fields, positioning of the sub-fields, the weights of the sub-fields and the types of the sub-fields as explained above.

In the pre-scaling unit 12, which receives the pre-scaling factor PS the RGB data words are normalised to the value which is assigned to the selected power level mode. Lets assume that Mode 2.08 has been selected. Then all pixel values of the picture are multiplied with the factor 210/255 in this unit.

The sub-field coding process is done in the sub-field coding unit 13. Here to each normalised pixel value a sub-field code word is assigned. For some values more than one possibility to assign a sub-field code word can be alternatively available. In a simple embodiment there may be a table for each mode so that the assignment is made with this table. Ambiguities can be avoided in this way.

The PWEF control block 11 also controls the writing WR of RGB pixel data in the frame memory 14, the reading RD of RGB sub-field data SF-R, SF-G, SF-B from the second frame memory 14, and the serial to parallel conversion circuit 15 via control line SP. Finally it generates the SCAN and SUSTAIN pulses required to drive the driver circuits for PDP 16.

Note that an implementation can be made with two frame memories best. Data is written into one frame memory pixel-wise, but read out from the other frame memory sub-field-wise. In order to be able to read the complete first sub-field a whole frame must already be present in the memory. This calls for the need of two whole frame memories. While one frame memory is being used for writing, the other is used for reading, avoiding in this way reading the wrong data.

The described implementation introduces a delay of 1 frame between power measurement and action. Power level is measured, and at the end of a given frame, the average power value becomes available to the controller. At that time it is however too late to take an action, for instance like modifying the sub-field coding, because data has already been written in memory.

For continuously running video this delay does not introduce any problems. However in case of a sequence change, a bright flash may occur. This happens when video changes from a dark sequence to a bright one. This can be a problem for the power supply, which perhaps will not be able to cope with an extreme peak in power.

To handle this problem, the control block can detect that 'wrong' data has been written in memory. The control block will react on that with the output of a blank screen for one frame, or if this is not acceptable, with a strong reduction of the number of sustain pulses for all sub-fields also for the duration of one frame, even at a cost of incurring in rounding mistakes which anyway will not be noticeable for a human viewer.

E.g. referring again to the previous example, if the measured average picture power of a picture just written to memory was calculated and the result corresponds to a power level of 460, but a mode with a power level of 1220 has been mistakenly used for sub-field encoding, a coarse correction can be performed, simply by suppressing two thirds of all sustain pulses in all sub-fields.

The blocks shown in FIG. 4 can be implemented with appropriate computer programs rather than with hardware components.

The invention is not restricted to the disclosed embodiments. Various modifications are possible and are considered to fall within the scope of the claims. E.g. a set of other power level modes can be used instead of the ones given here, exemplary.

The invention can be used for all kinds of displays which are controlled by using a PWM like control of the light emission for grey-level variation.

What is claimed is:

1. Method for power level control in a display device having a plurality of luminous elements corresponding to the pixels of a picture, wherein the time duration of a video frame or video field is divided into a plurality of sub-fields during which the luminous elements can be activated for light emission in small pulses corresponding to a sub-filed code word which is used for brightness control, wherein a set of power level modes is provided for sub-field coding, wherein to each power level mode a characteristic sub-field organization belongs defining a characteristic power level value, the sub-field organization being variable in respect to one or more of the following characteristics:

the number of sub-fields;

the sub-field type;

the sub-field position;

the sub-filed weight;

the sub-field pre-scaling; and a factor for the sub-field weights which is used to vary the amount of small pulses generated during each sub-filed;

said method comprising steps of:

determining a value which is characteristic for the power level of a video picture;

selecting a corresponding power level mode for the sub-field coding wherein the switching between power level modes corresponding to the characteristic value for the power level of the video picture is controlled with an hysteresis like switching which is implemented for the dynamic control of the power level mode selection as a function of the measured picture average power.

2. Method according to claim 1, wherein the sub-field organizations for the main power level modes are further variable in respect to the sub-field types, which means that in particular there are common sub-fields in a sub-field organization and a common sub-field has a characteristic that during its addressing period two consecutive lines of the display are addressed in parallel, whereas the specific sub-fields have the characteristic that only a single line is addressed during the addressing period.

3. Method according to claim 1, wherein the characteristic value for the power level of a video picture is the average picture power level.

4. Method according to claim 1, wherein for the hysteresis like switching control two parallel linear falling lines in a power level mode versus picture average power diagram are used and the following rules are applied:

i) when picture average power is increasing, modes with power levels on the top linear falling line are chosen;

ii) when picture average power is decreasing, modes with power levels on the bottom linear falling line are chosen;

iii) in case the picture average power growth direction changes, the switching to a new power level mode is suppressed until the picture average power level lies on the respective other bottom or top linear falling line.

5. An apparatus for carrying out the method according to claim 1 comprising:

an average picture power measuring circuit in which the average picture power is measured for determining the characteristic value for the power level of a video picture;

a power level control unit which determines which power level mode is to be taking in consideration the previous measured average picture power value;

a pre-scaling unit, which performs a normalization of the input video levels with a specific factor;

a sub-field encoding unit in which to a normalized input video level a sub-filed code word is assigned for brightness control, corresponding to the selected power level mode; and wherein a hysteresis curve implemented for the dynamic control of the power level mode selection as a function of the measured picture average power is taken in consideration in the power level control unit for selection of the power level mode.

6. Apparatus according to claim 5, wherein it is integrated in a display device, in particular plasma display device.

* * * * *